US011738233B1

(12) United States Patent
Cohen

(10) Patent No.: US 11,738,233 B1
(45) Date of Patent: Aug. 29, 2023

(54) APPARATUS FOR EXERCISE

(71) Applicant: Donald Paul Cohen, Charleston, WV (US)

(72) Inventor: Donald Paul Cohen, Charleston, WV (US)

( * ) Notice: Subject to any disclaimer, the term of this patent is extended or adjusted under 35 U.S.C. 154(b) by 0 days.

(21) Appl. No.: 17/851,044

(22) Filed: Jun. 28, 2022

(51) Int. Cl.
*A63B 21/16* (2006.01)
*A63B 21/055* (2006.01)
*A63B 21/04* (2006.01)

(52) U.S. Cl.
CPC ..... *A63B 21/16* (2013.01); *A63B 21/0442* (2013.01); *A63B 21/0552* (2013.01)

(58) Field of Classification Search
CPC . A63B 21/16; A63B 21/0442; A63B 21/0552; A63B 21/068; A63B 71/0036; A63B 23/03558; A63B 3/00; A63B 21/00047; A63B 17/04; A63B 1/00; A63B 23/1218; A63B 23/0458; A63B 2210/50; A63B 2071/025; A63B 2225/09; B65D 81/36; B65D 25/30; B65D 25/10
See application file for complete search history.

(56) References Cited

U.S. PATENT DOCUMENTS 4,286,782 A * 9/1981 Fuhrhop ..... A63B 23/00 482/99
4,527,797 A * 7/1985 Slade, Jr. ..... A63B 21/0626 482/104
7,699,756 B2 * 4/2010 Piane, Jr. ..... A63B 71/0036 248/222.52
7,794,374 B1 * 9/2010 Park ..... A63B 23/12 482/122
9,289,638 B2 * 3/2016 Towley, III ..... A63B 21/00047
9,675,831 B2 * 6/2017 Beaver ..... A63B 1/00
RE46,874 E * 5/2018 D'Silva ..... A63B 7/02
9,993,678 B2 * 6/2018 Hopperstad ..... A63B 17/04
10,071,275 B2 * 9/2018 Beaver ..... A63B 23/0458
10,576,352 B2 * 3/2020 Vester ..... A63B 21/4029
10,926,151 B2 * 2/2021 Dunahay ..... A63B 23/1218
11,298,577 B2 * 4/2022 Watterson ..... A63B 21/154
11,369,855 B2 * 6/2022 Vester ..... A63B 21/4029
2007/0049472 A1 * 3/2007 Hummer ..... A63B 71/0036 482/104

(Continued)

*Primary Examiner* — Andrew S Lo
*Assistant Examiner* — Andrew M Kobylarz
(74) *Attorney, Agent, or Firm* — Thomas Y. Kendrick; Benjamen E. Kern; Kern Kendrick LLC

(57) ABSTRACT

In one aspect, an exercise apparatus is provided, the apparatus comprising: an exercise engagement portion comprising two vertical members and two or more horizontal members extending between the two vertical members, wherein the two or more horizontal members include longitudinal ends and wherein the longitudinal ends are connected to the two vertical members, wherein the two or more horizontal members include a plurality of horizontal member holes, and wherein the two vertical members include a plurality of vertical member holes; a base portion including two ballast containers, each of the ballast containers including: a vertical member base having a channel, and one or more compartment for containing a ballast; and wherein each of the two vertical members extends into the channel of the vertical member base such that the vertical member base maintains the vertical member in a vertical position.

9 Claims, 24 Drawing Sheets

(56) References Cited

U.S. PATENT DOCUMENTS

| | | | | |
|---|---|---|---|---|
| 2012/0329613 | A1* | 12/2012 | Schiano | A63B 21/078<br>29/428 |
| 2015/0014212 | A1* | 1/2015 | Beaver | B65D 25/10<br>206/579 |
| 2018/0243597 | A1* | 8/2018 | Schlegel | A63B 17/04 |
| 2019/0118022 | A1* | 4/2019 | Carter | A63B 21/16 |

* cited by examiner

APPARATUS FOR EXERCISE

BACKGROUND

It is well known that engaging in regular physical exercise provides numerous health benefits. However, access to convenient exercise apparatuses is not always available. For example, during the COVID-19 pandemic, directives requiring that citizens remain in their homes prevented those citizens from visiting gyms. Additionally, when one travels to an area away from one's gym (e.g., while vacationing), one often cannot access the same exercise equipment to which one has grown accustomed.

What is needed is a convenient, easy to assemble apparatus for use in exercising. The apparatus may be portable and designed to be assembled without the use of any tools. The apparatus may alternatively be fixed in position in a convenient location, such as in one's home, one's office, hotel fitness areas, a hospital or assisted living facility, and the like.

SUMMARY

In one aspect, an exercise apparatus is provided, the apparatus comprising: an exercise engagement portion comprising two vertical members and two or more horizontal members extending between the two vertical members, wherein the two or more horizontal members include longitudinal ends and wherein the longitudinal ends are connected to the two vertical members, wherein the two or more horizontal members include a plurality of horizontal member holes, and wherein the two vertical members include a plurality of vertical member holes; a base portion including two ballast containers, each of the ballast containers including: a vertical member base having a channel, and one or more compartment for containing a ballast; and wherein each of the two vertical members extends into the channel of the vertical member base such that the vertical member base maintains the vertical member in a vertical position.

In another aspect, an exercise apparatus is provided, the apparatus comprising: an exercise engagement portion comprising two vertical members and two or more horizontal members extending between the two vertical members, wherein the two or more horizontal members include longitudinal ends and wherein the longitudinal ends are connected to the two vertical members, wherein the two or more horizontal members include a plurality of horizontal member holes, and wherein the two vertical members include a plurality of vertical member holes; and a vertical member base pad fixed to a lower longitudinal end of each of the two vertical members, wherein the vertical member base pad is secured to a horizontal floor.

In another aspect, an exercise apparatus is provided, the apparatus comprising: an exercise engagement portion comprising two vertical members and two or more horizontal members extending between the two vertical members, wherein the two or more horizontal members include longitudinal ends and wherein the longitudinal ends are connected to the two vertical members, wherein the two or more horizontal members include a plurality of horizontal member holes, and wherein the two vertical members include a plurality of vertical member holes; and wherein each of the two vertical members is secured to a vertical wall.

BRIEF DESCRIPTION OF THE FIGURES

The accompanying figures, which are incorporated in and constitute a part of the specification, illustrate various example systems and apparatuses, and are used merely to illustrate various example embodiments. In the figures, like elements bear like reference numerals.

DETAILED DESCRIPTION

Figure 1A:
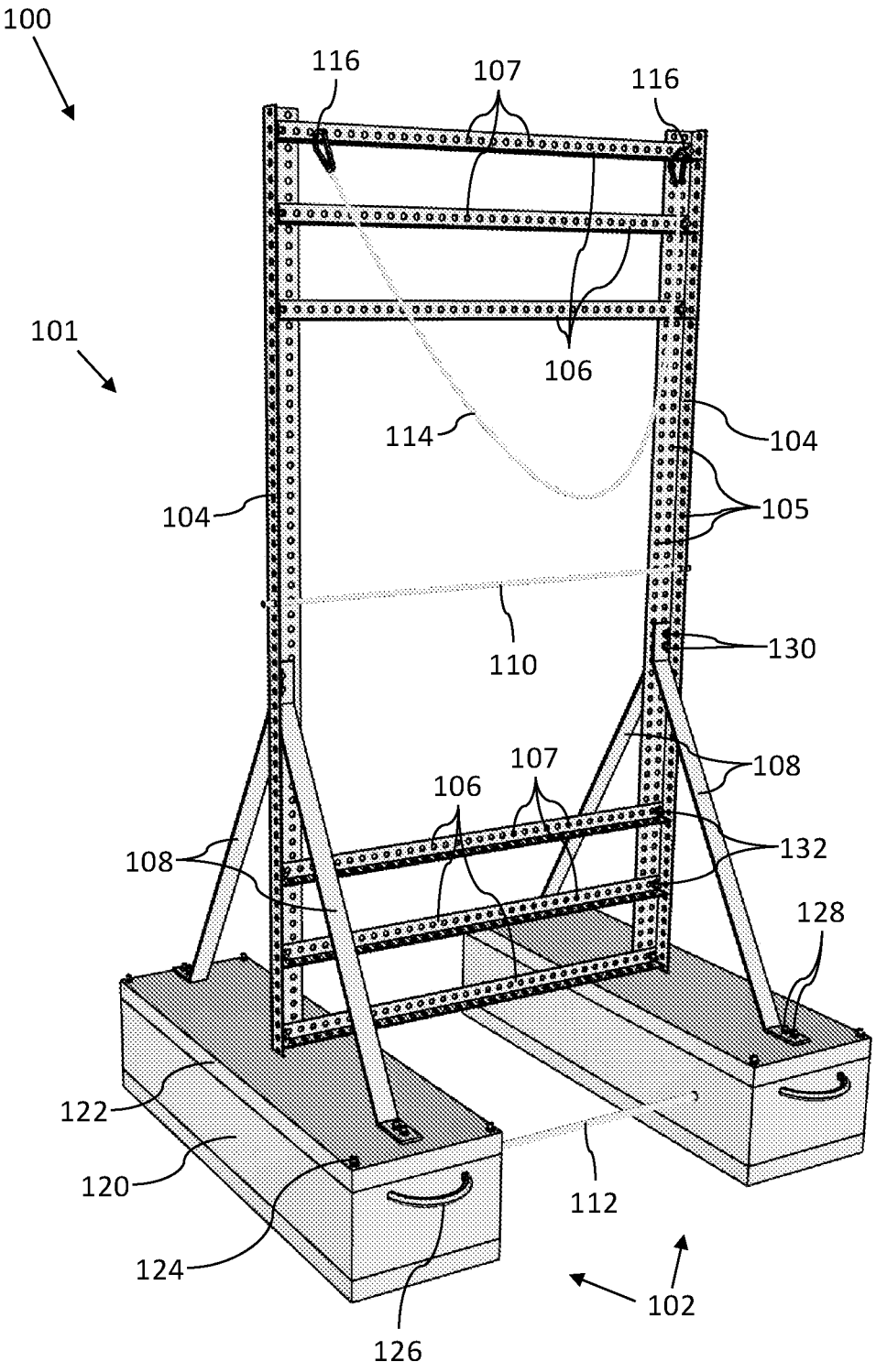
FIG. 1A illustrates a front perspective view of an exercise apparatus 100 incorporating a resistance band 114 in a first position.
Figure 1B:
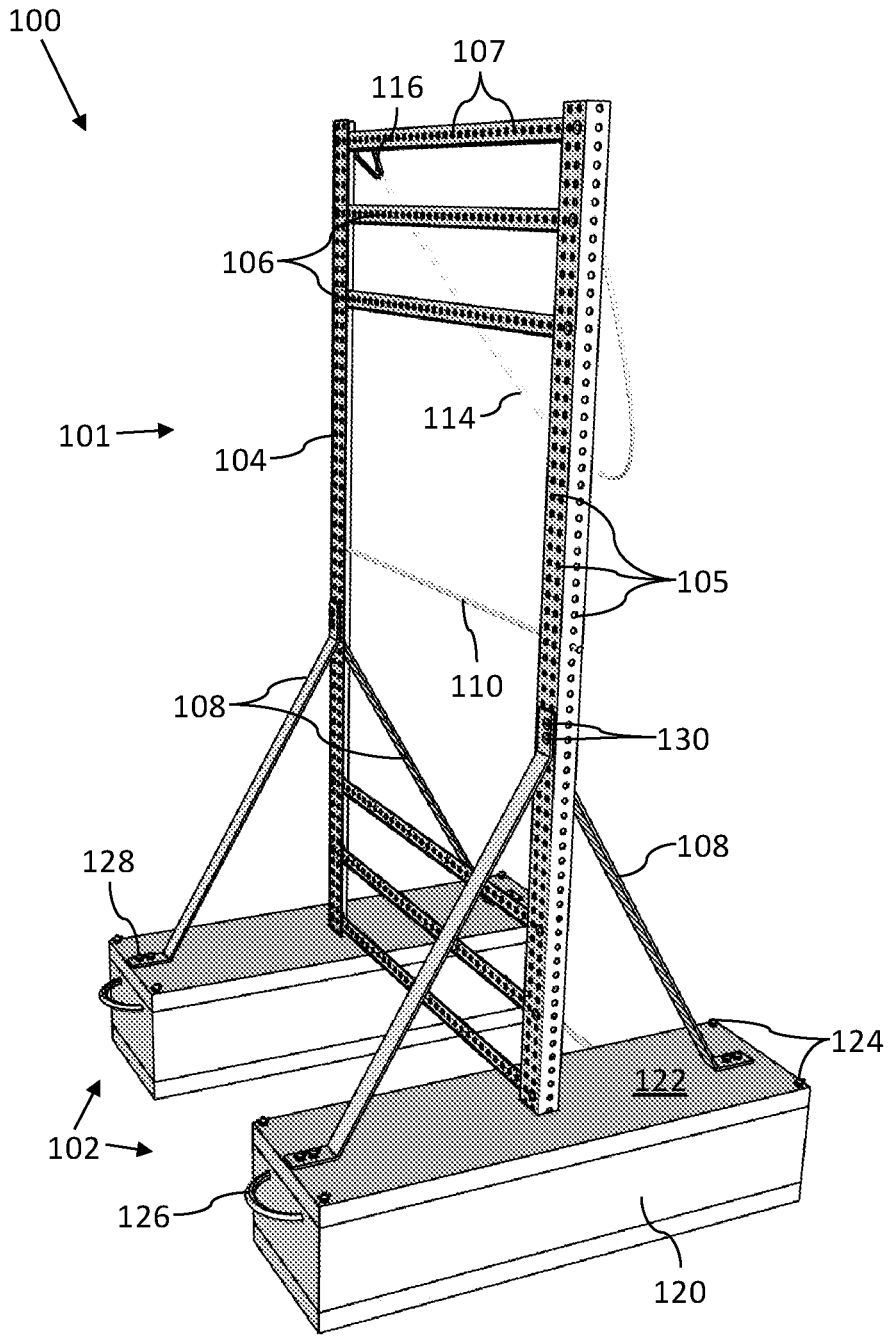
FIG. 1B illustrates a rear perspective view of exercise apparatus 100 incorporating resistance band 114 in the first position.
Figure 1C:
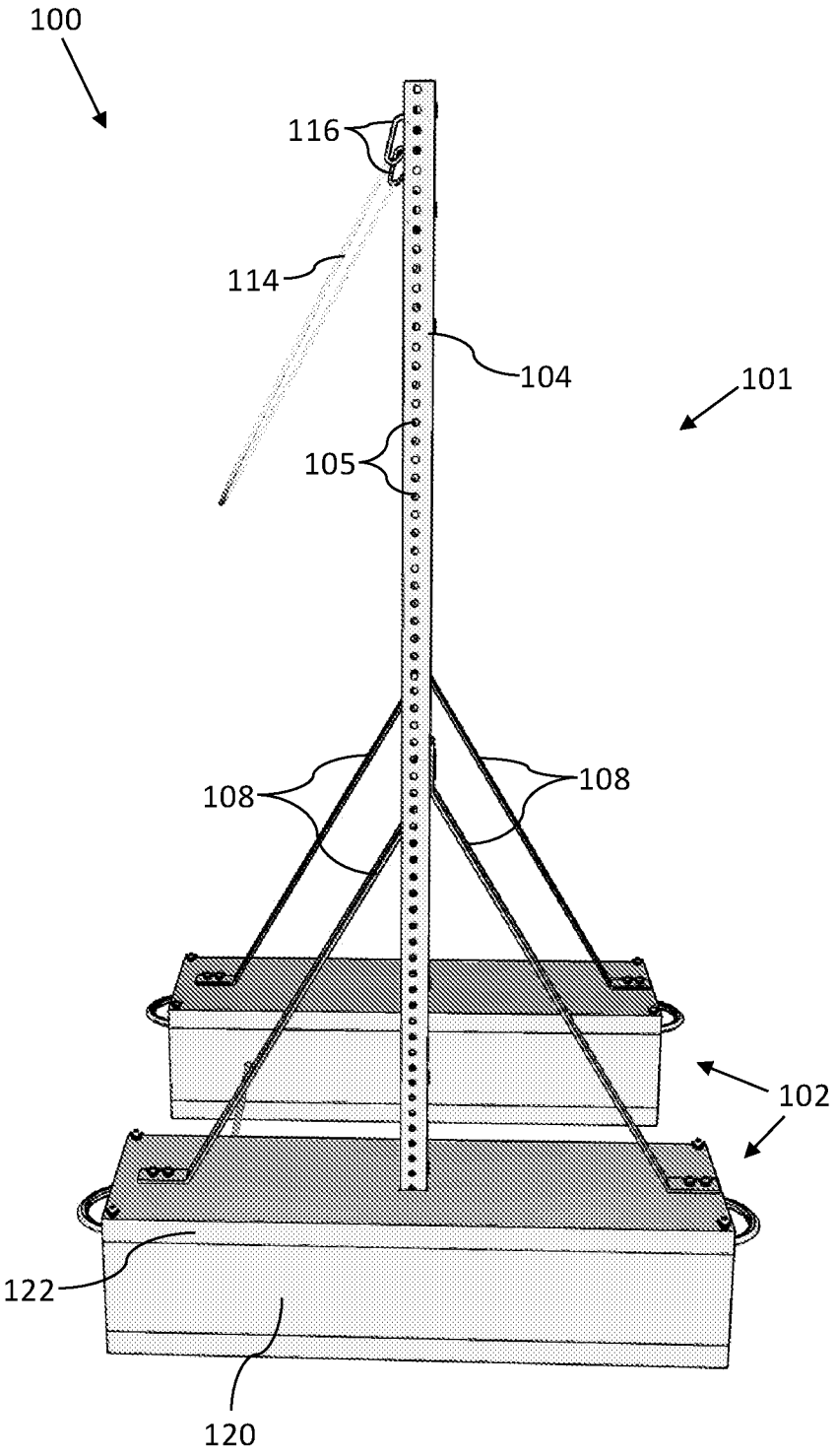
FIG. 1C illustrates a side perspective view of exercise apparatus 100 incorporating resistance band 114 in the first position.
Figure 1D:
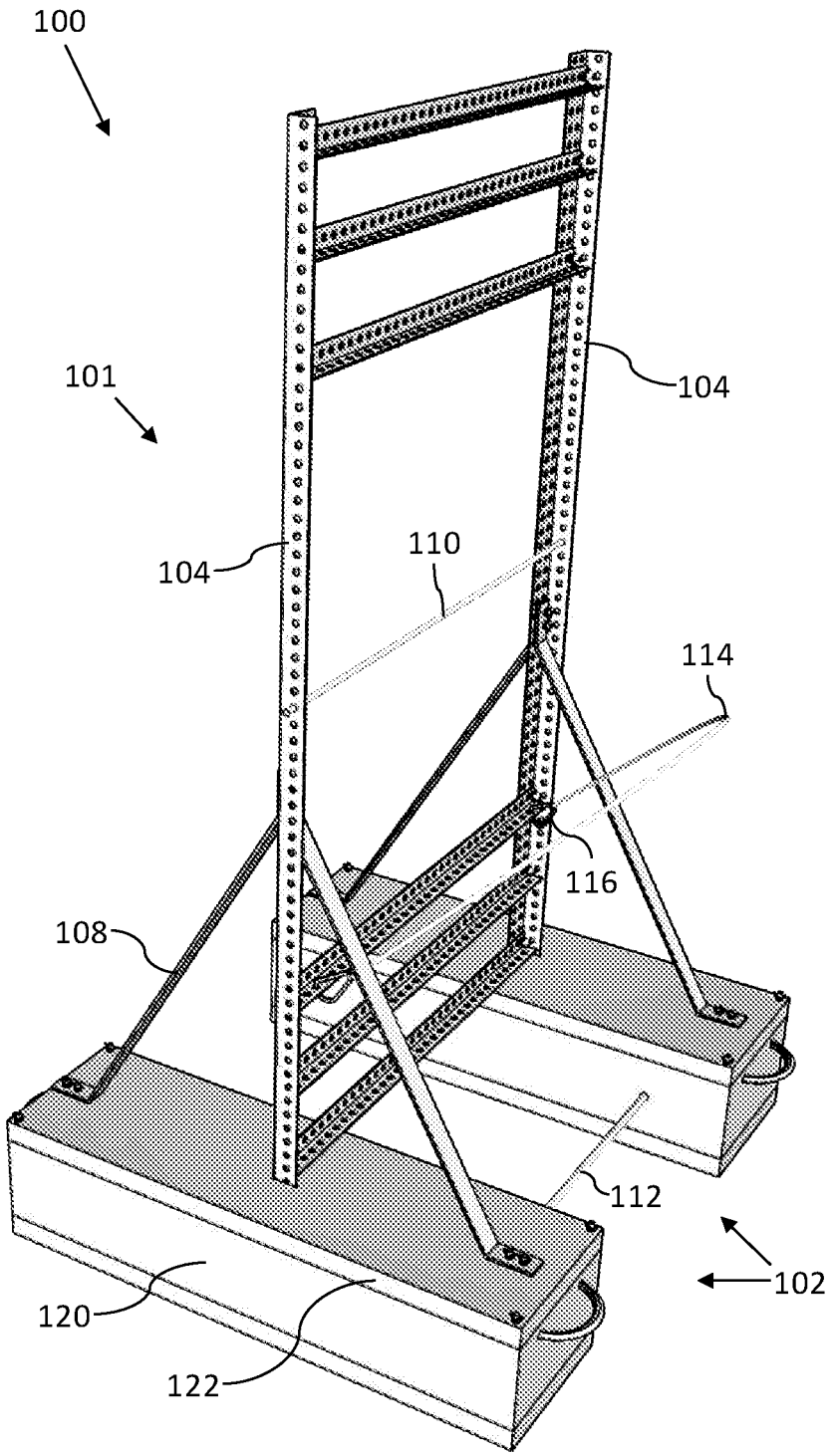
FIG. 1D illustrates a front perspective view of exercise apparatus 100 incorporating resistance band 114 in a second position.
Figure 1E:
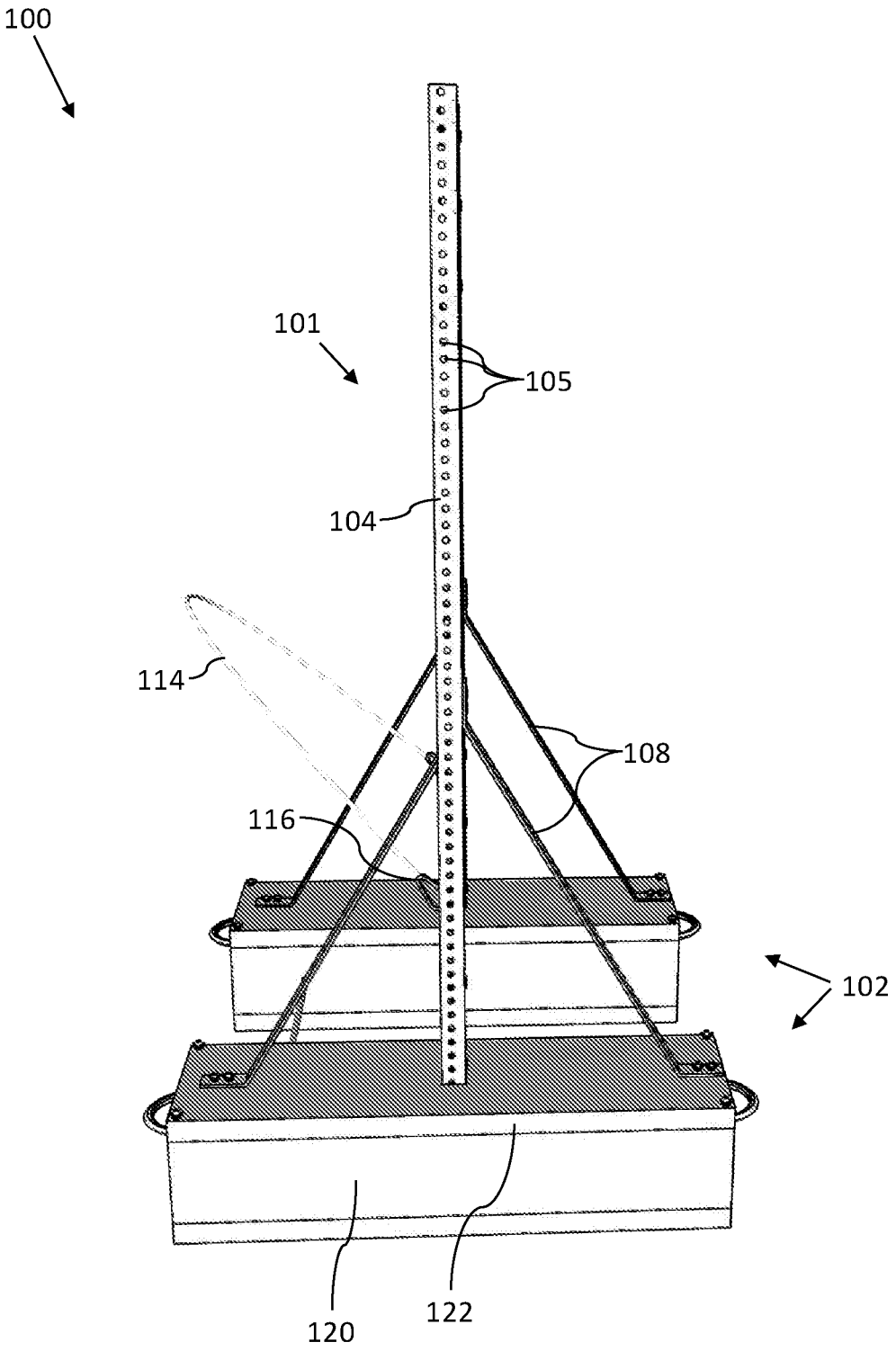
FIG. 1E illustrates a side perspective view of exercise apparatus 100 incorporating resistance band 114 in the second position.
Figure 1F:
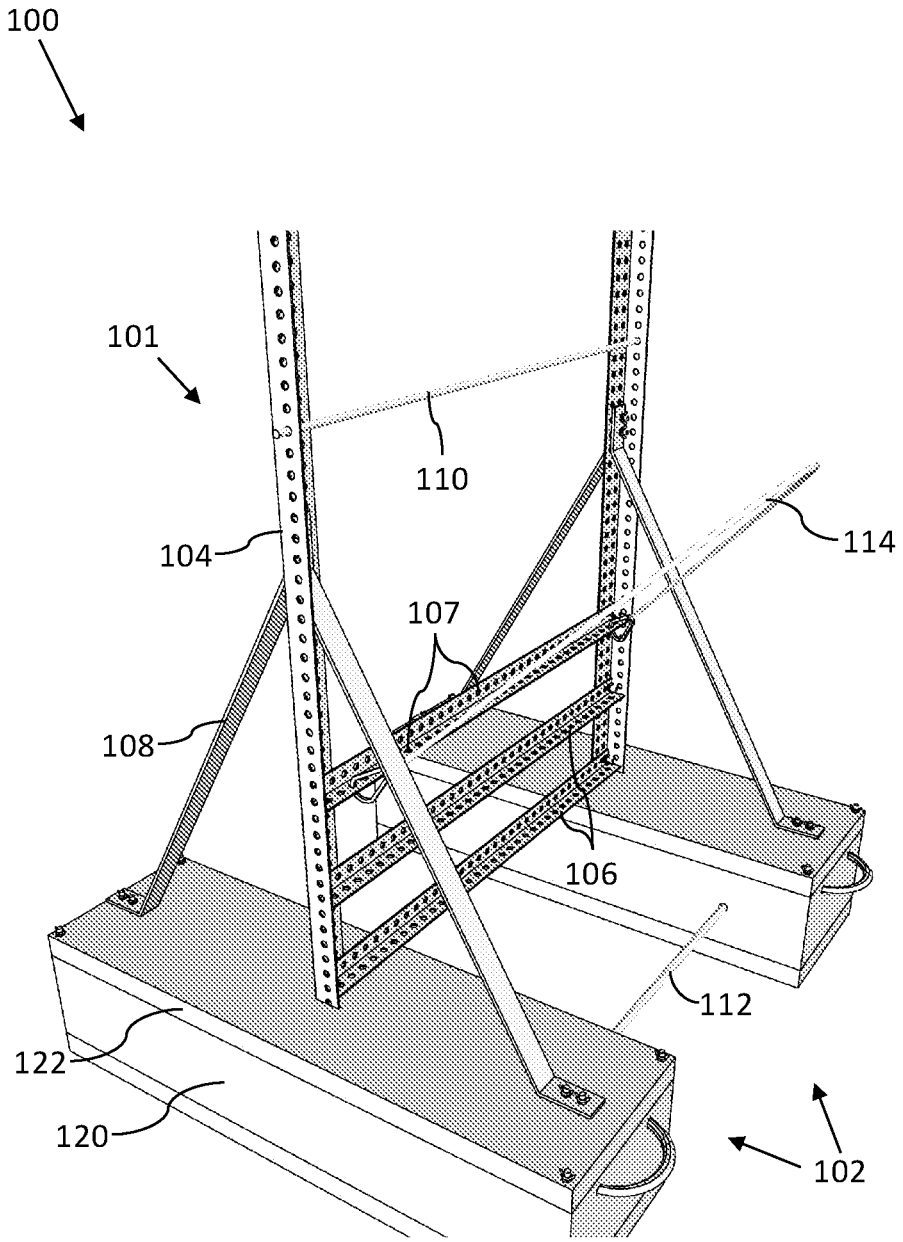
FIG. 1F illustrates a partial front perspective view of exercise apparatus 100 incorporating resistance band 114 in the second position.
Figure 1G:
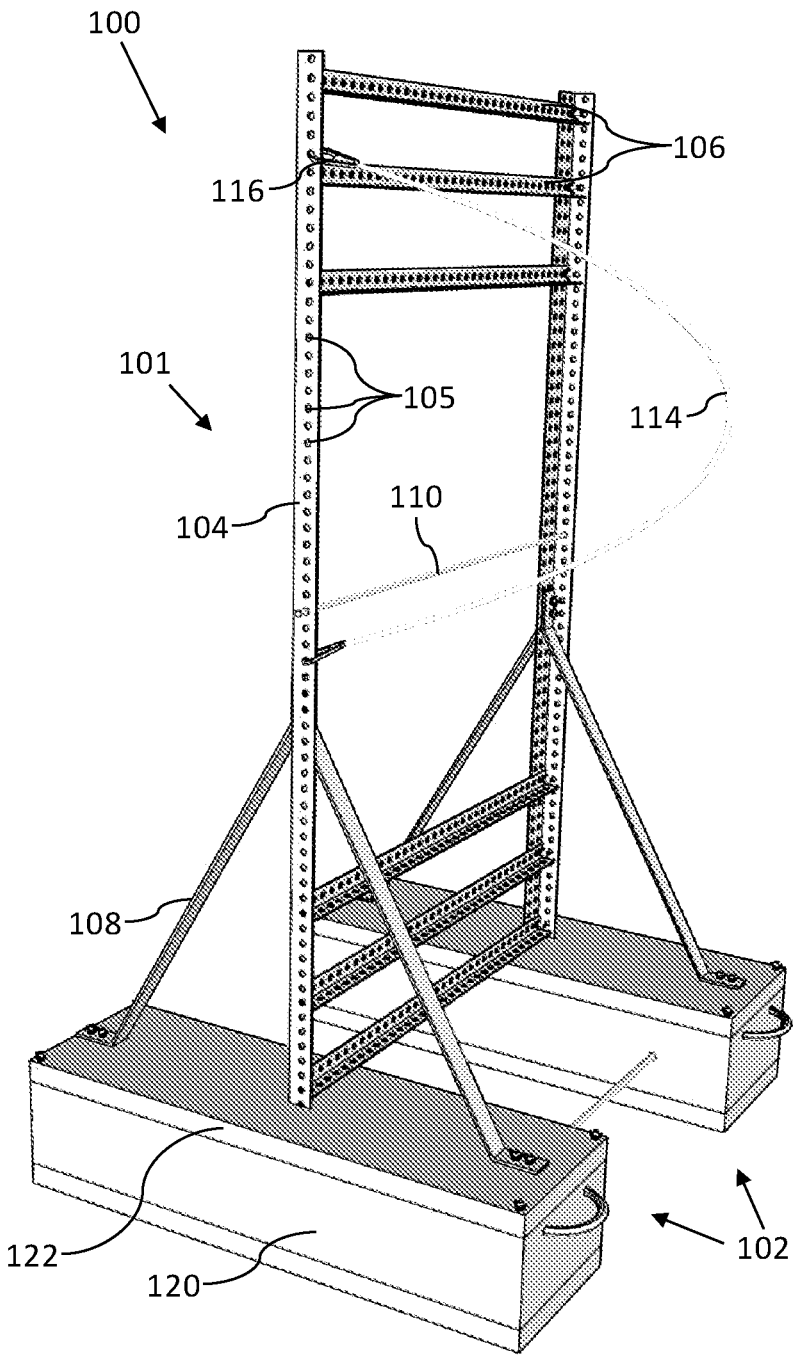
FIG. 1G illustrates a front perspective view of exercise apparatus 100 incorporating resistance band 114 in a third position.
Figure 1H:
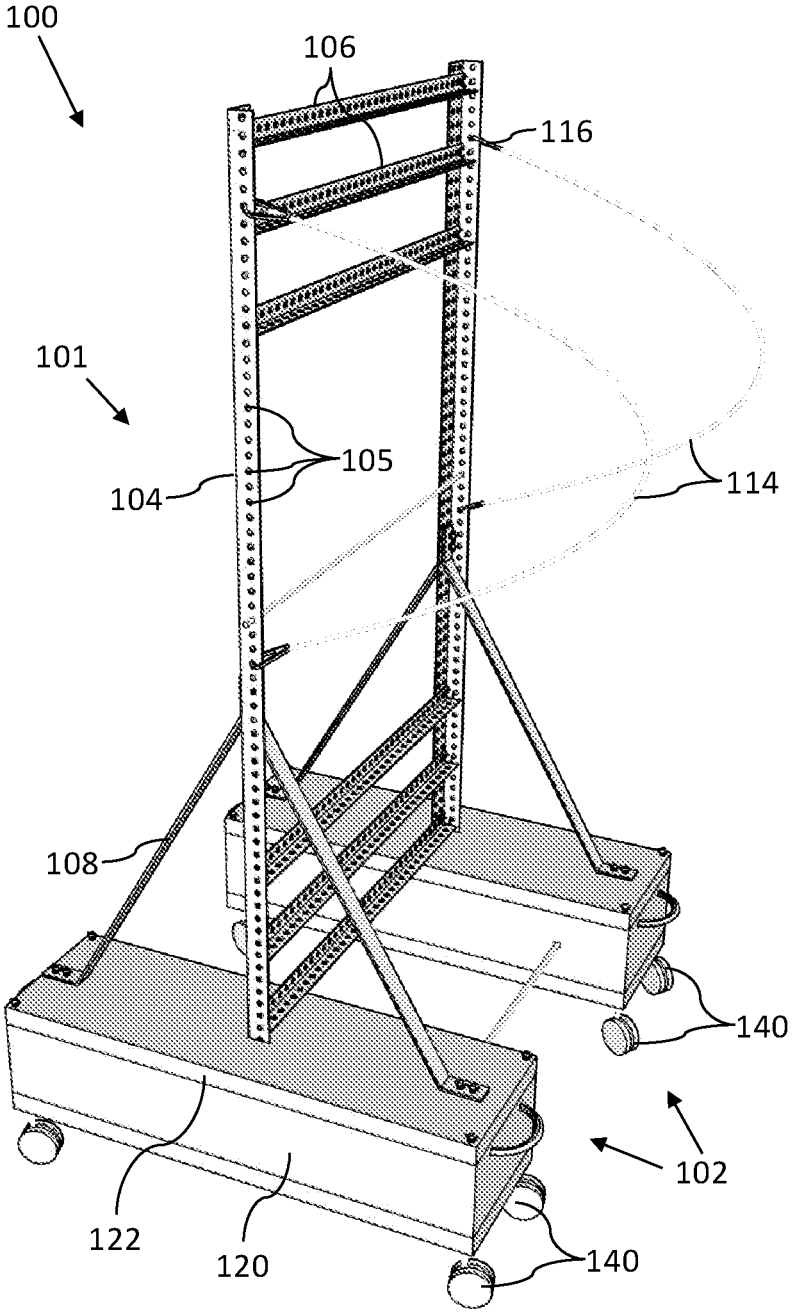
FIG. 1H illustrates a front perspective view of exercise apparatus 100 incorporating resistance band 114 in a fourth position.
Figure 1I:
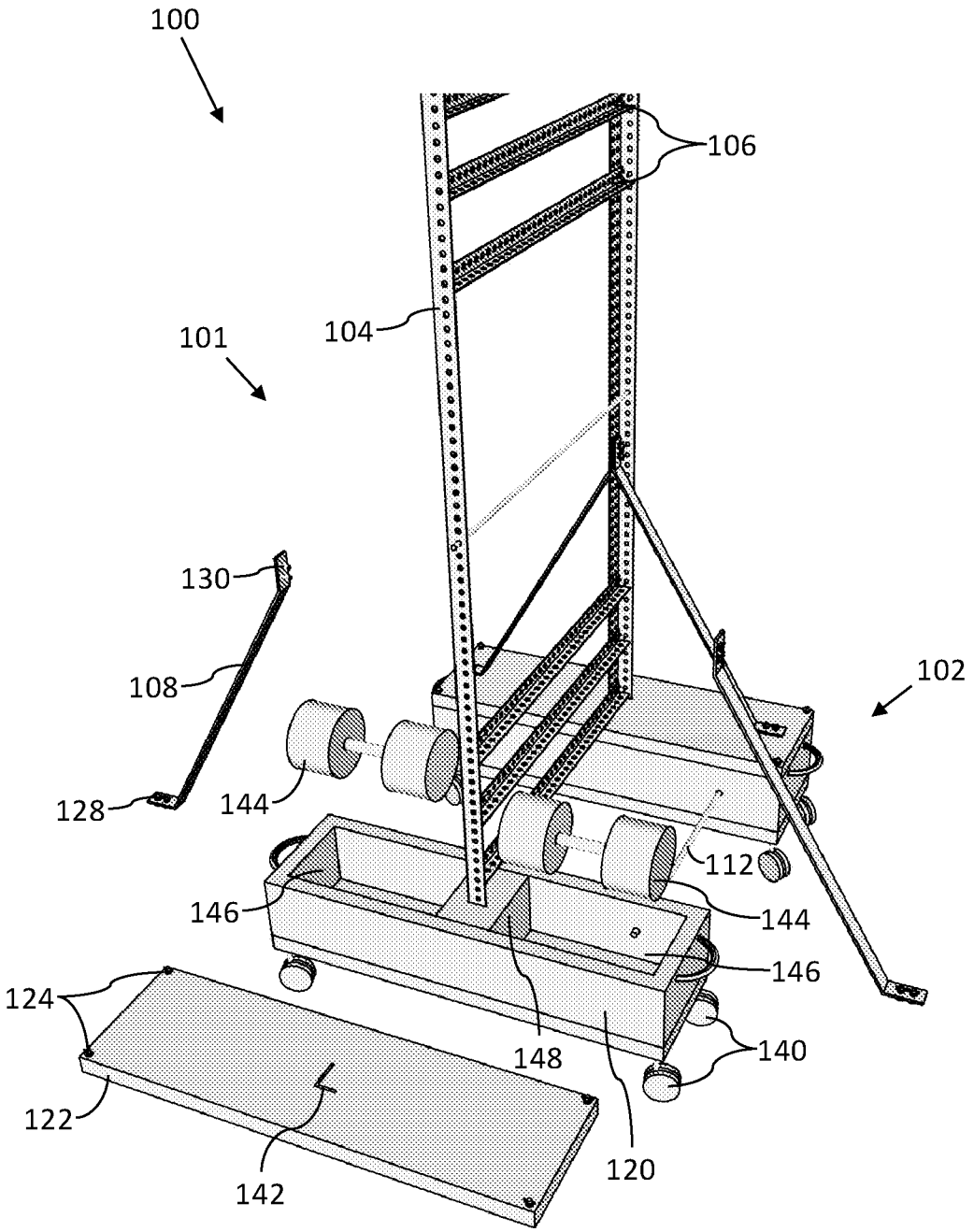
FIG. 1I illustrates a partial exploded view of exercise apparatus 100.
Figure 1J:
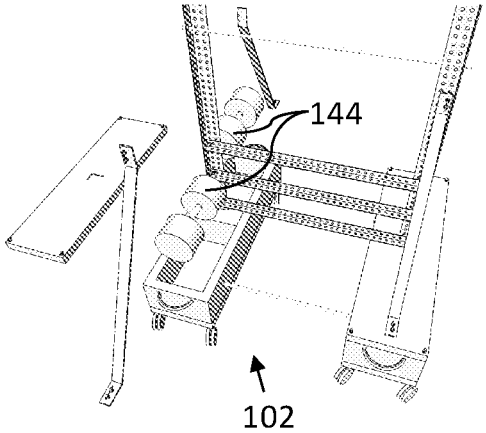
FIG. 1J illustrates a partial exploded view of exercise apparatus 100.
Figure 1K:
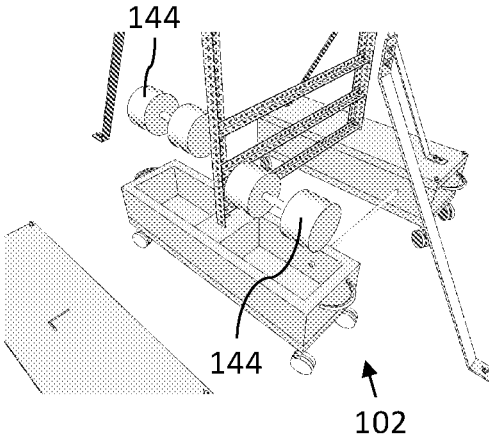
FIG. 1K illustrates a partial exploded view of exercise apparatus 100.
Figure 1L:
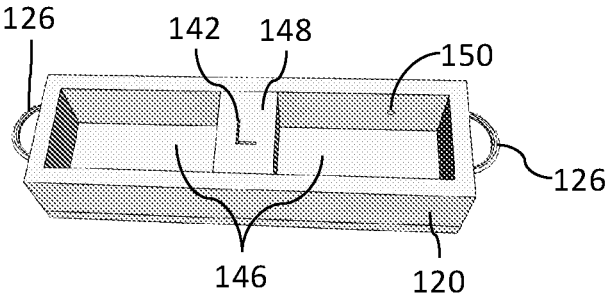
FIG. 1L illustrates a perspective view of a base portion 102 of apparatus 100.
Figure 1M:
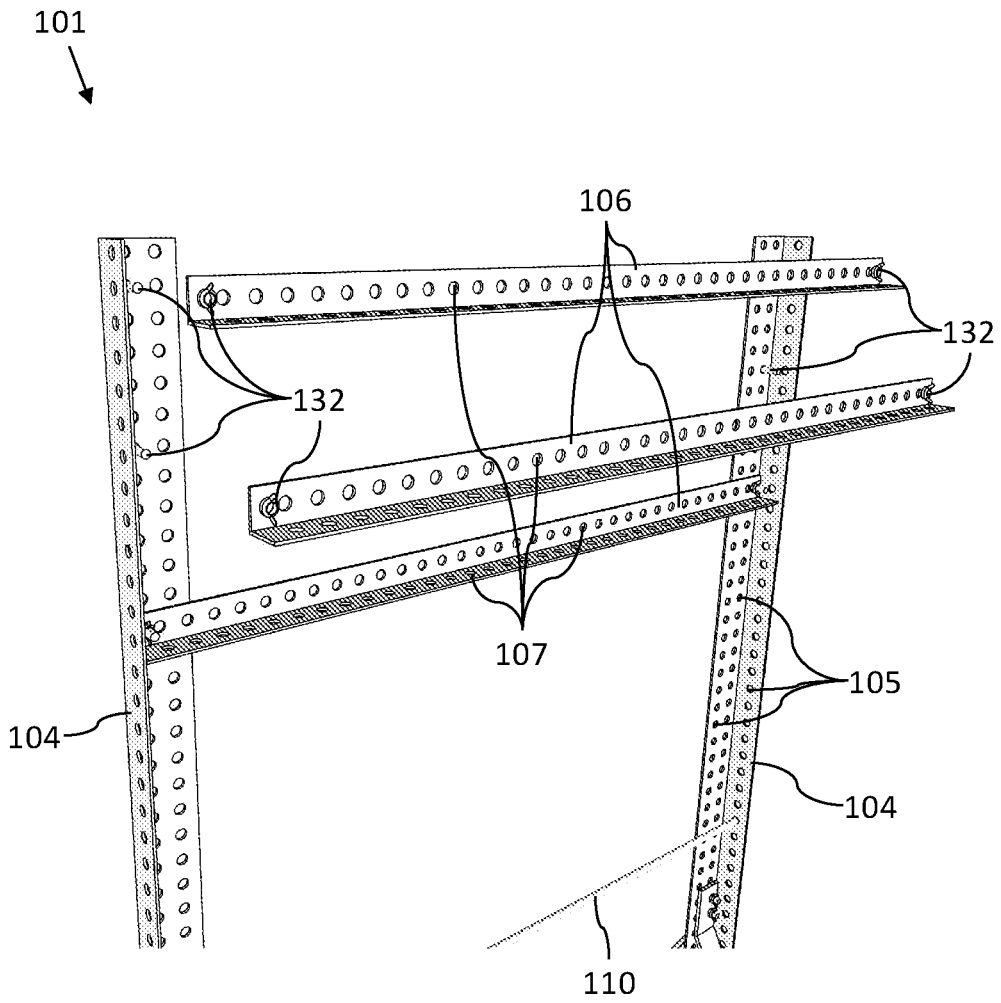
FIG. 1M illustrates a partial exploded view of exercise apparatus 100.
Figure 1N:
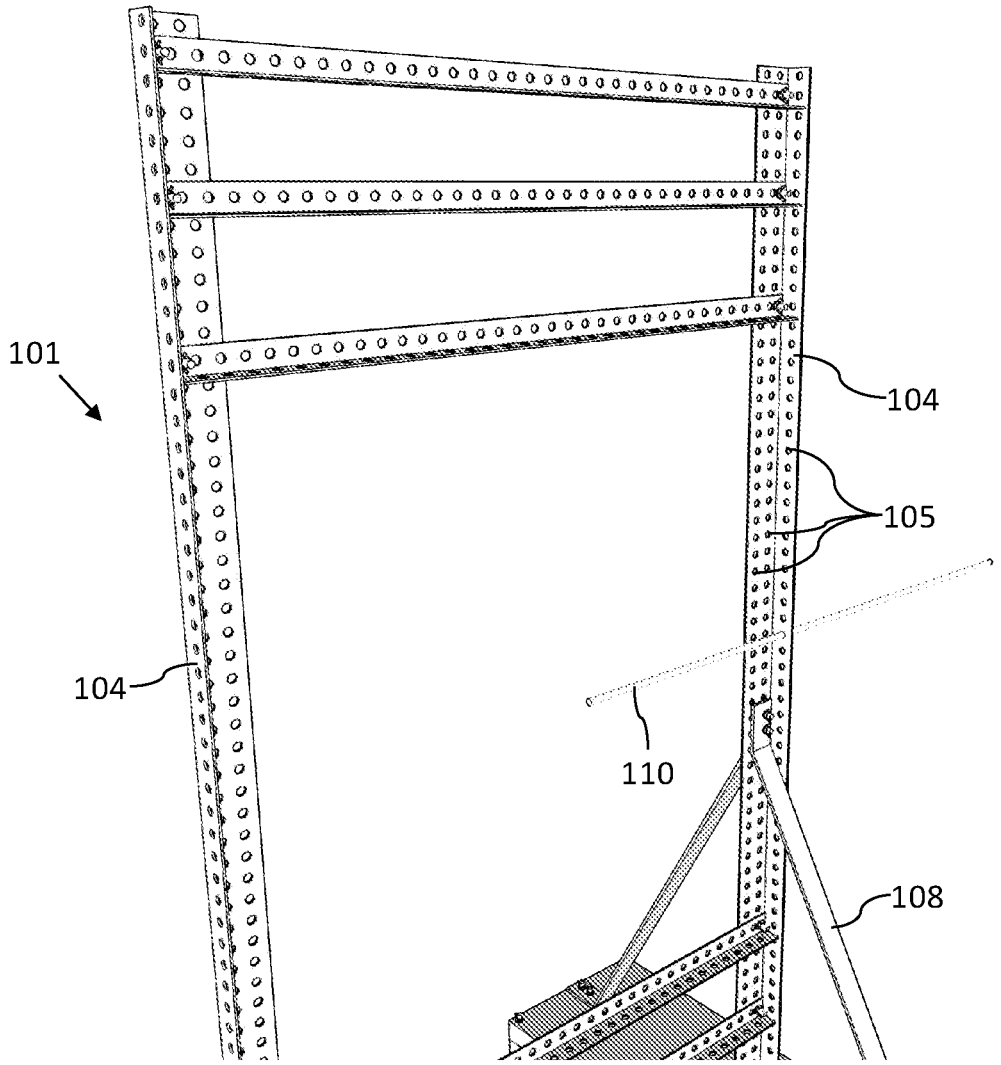
FIG. 1N illustrates a partial exploded view of exercise apparatus 100.
Figure 1O:
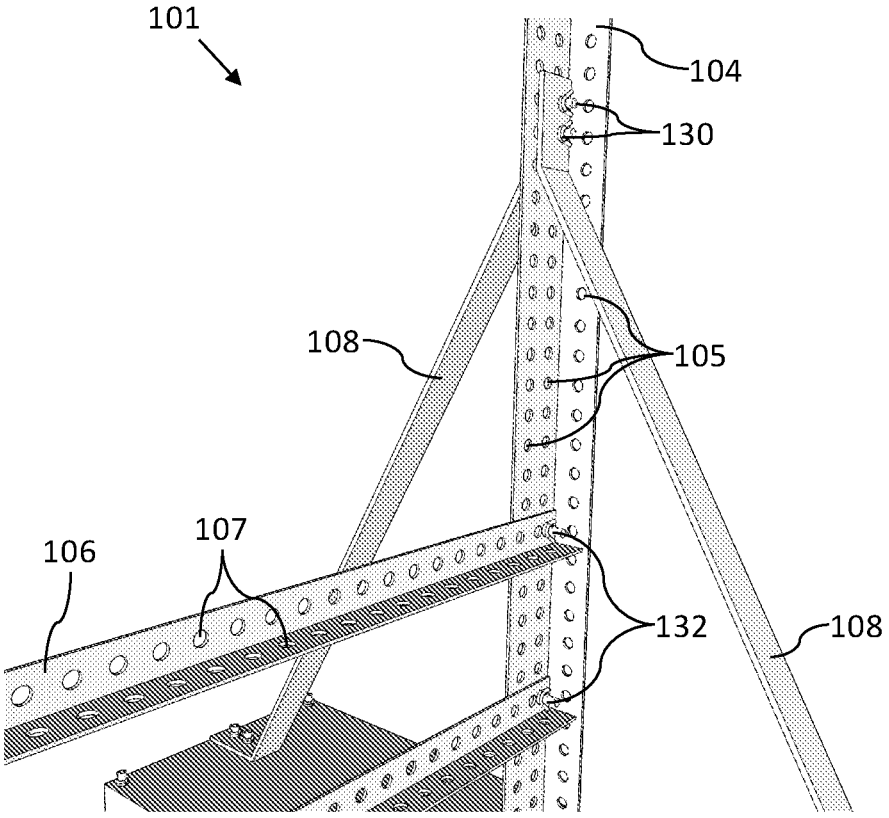
FIG. 1O illustrates a partial perspective view of exercise apparatus 100.
Figure 1P:
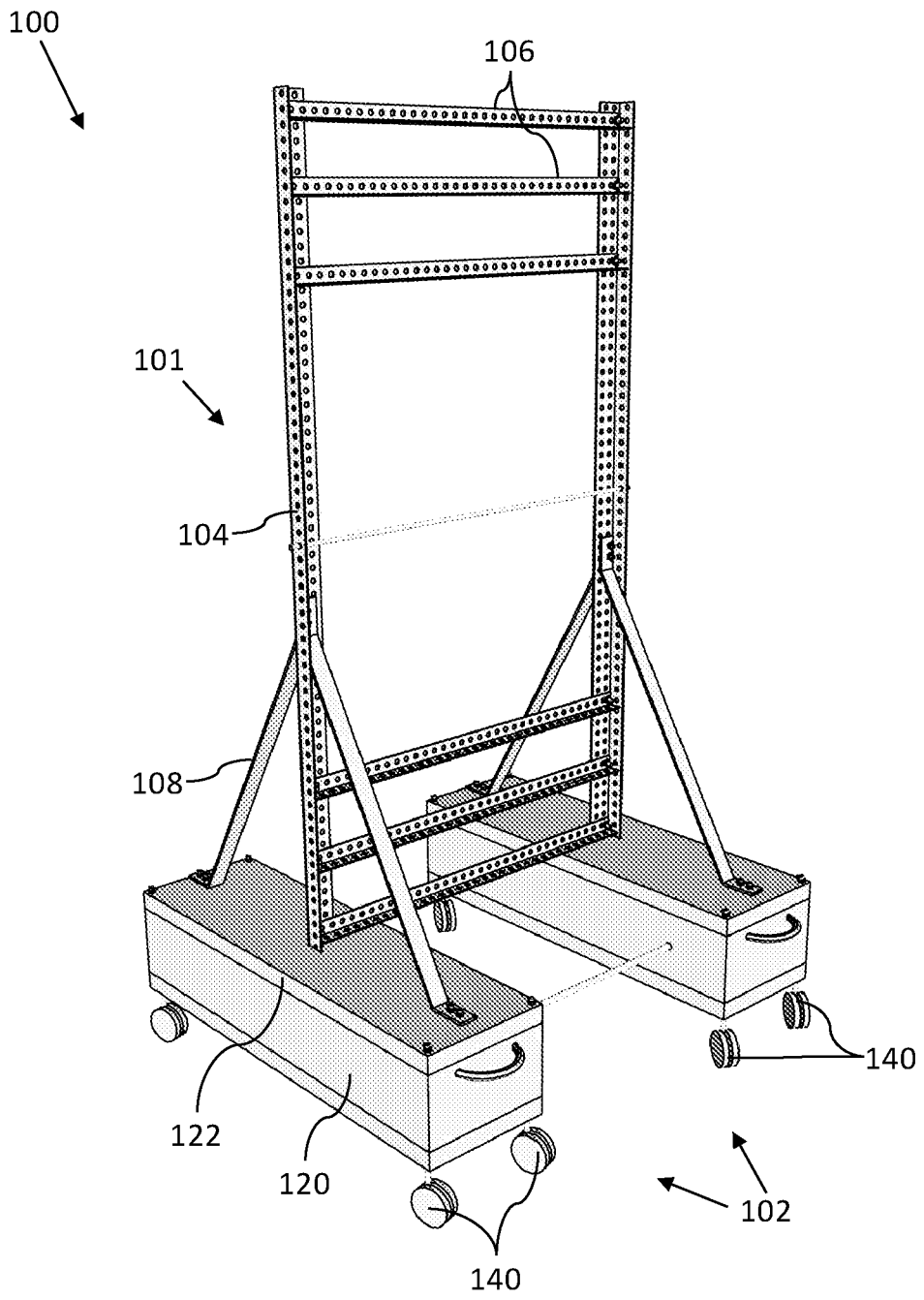
FIG. 1P illustrates a front perspective view of exercise apparatus 100 including casters 140.
Figure 1Q:
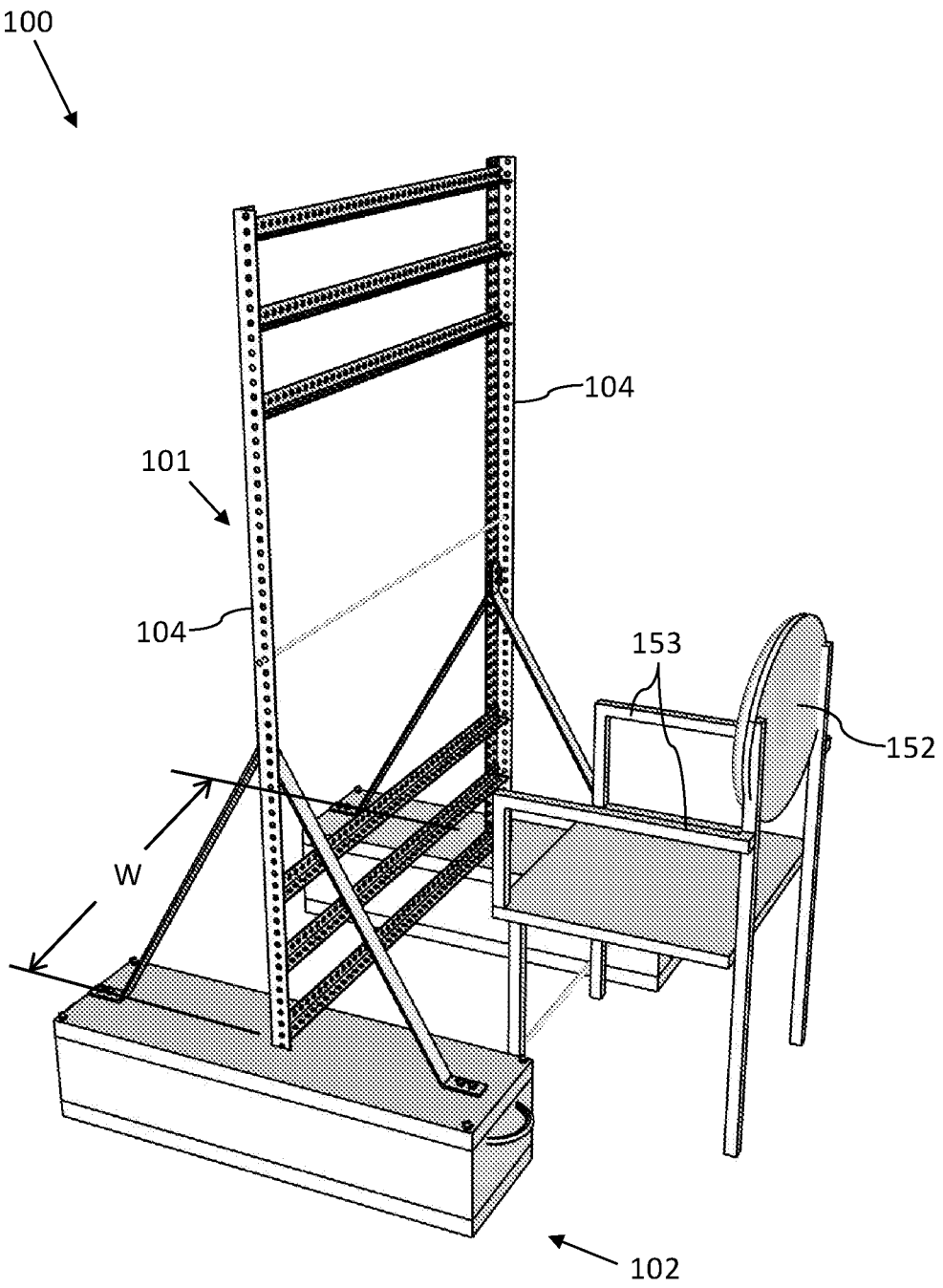
FIG. 1Q illustrates a front perspective view of exercise apparatus 100 used with a chair 152.
Figure 1R:
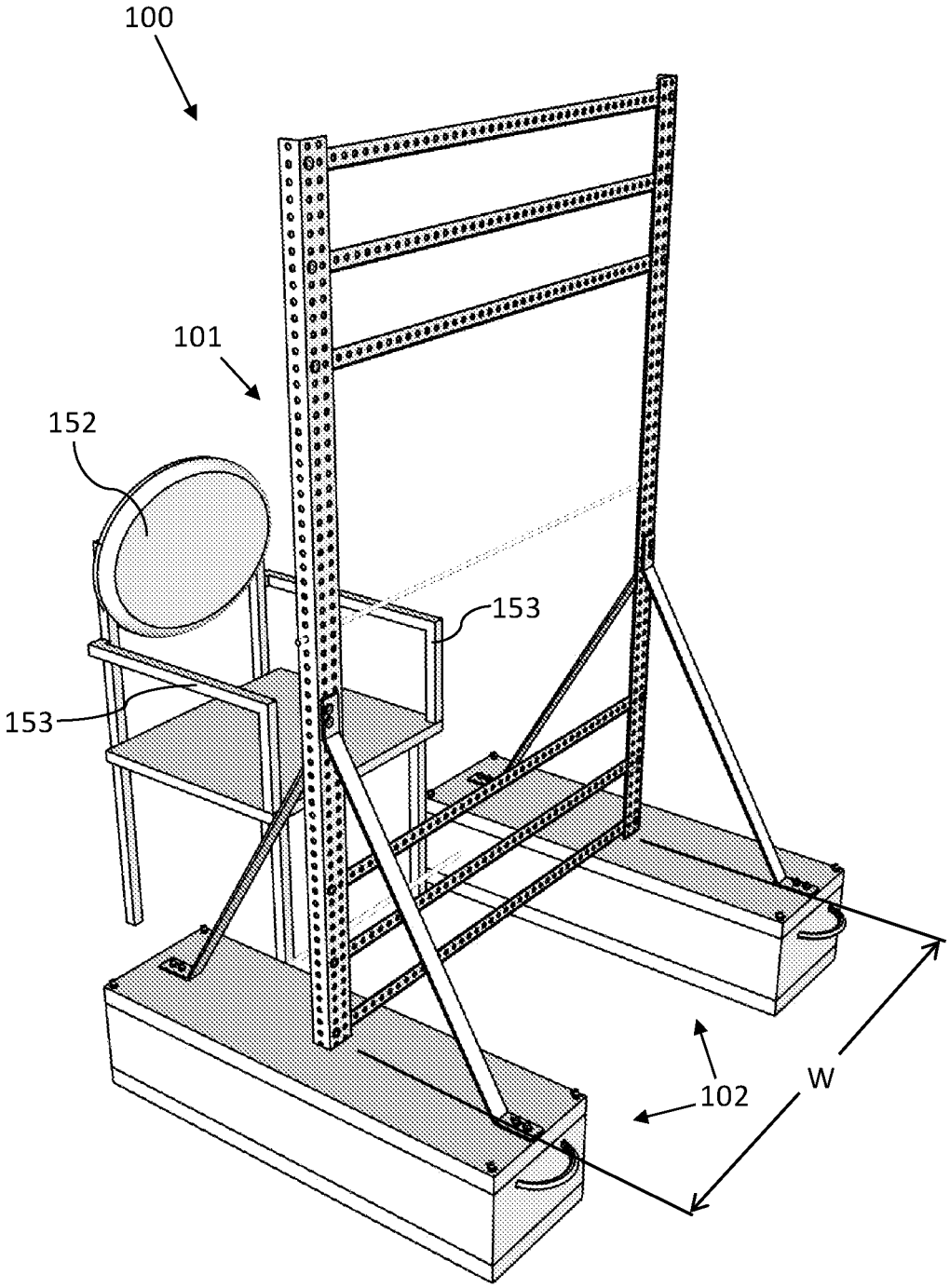
FIG. 1R illustrates a rear perspective view of exercise apparatus 100 used with chair 152.

FIGS. 1A-1R illustrate an exercise apparatus 100. Apparatus 100 includes an exercise engagement portion 101 and a base portion 102.

Exercise engagement portion 101 includes one or more vertical member 104 and one or more horizontal member 106. Exercise engagement portion 101 may include two vertical members 104 with a plurality of horizontal members 106 extending between vertical members 104, the longitudinal ends of horizontal members 106 being connected to vertical members 104. Horizontal members 106 may be connected to vertical members 104 by one or more fastener 132.

Vertical members 104 may include a plurality of vertical member holes 105 along the length and/or width of vertical members 104. Horizontal members 106 may include a plurality of horizontal member holes 107 along the length and/or width of horizontal members 106. Vertical member holes 105 and horizontal member holes 107 may be spaced, evenly or unevenly, along the longitudinal length of vertical members 104 and horizontal members 106, the spacing being one or more of 0.50 in., 0.75 in., 1.00 in., 1.25 in., 1.50 in., 1.75 in., 2.00 in. and the like.

One or more of vertical members 104 may be an angle iron. One or more of horizonal members 106 may be an angle iron. In one aspect, slotted angle iron may be used for vertical members 104 or horizontal members 106. The use of angle iron may provide both strength to vertical members 104 and/or horizontal members 106, as well as variety in the fixing of a resistance band to vertical members 104 and/or horizontal members 106.

Apparatus 100 may be used with one or more resistance band 114 having clips 116 at the terminal ends of resistance band 114. Clips 116 may include spring clips, hooks, or the like. Resistance band 114 may be formed from a resilient material, including for example, a rubber material. Resistance band 114 requires a user to apply energy to resistance band 114 to stretch it, thus providing a load to the user's muscles resulting in exercise. Clips 116 may engage any of vertical member holes 105 and horizontal member holes 107 as desired by a user to accommodate the user's size (e.g., height), position (e.g., standing versus seated), and desired exercise (e.g., biceps exercise versus triceps exercise). Various example alternative positions of resistance band 114 are illustrated in FIGS. 1A, 1D, 1G, and 1H. These alternative positions are not intended to be limiting, but rather, simply illustrate some possible positioning of resistance band 114 for various exercises.

Apparatus 100 may be used with resistance bands 114 of varying resistances as desired by a user. Resistance band 114 may be shortened as necessary to perform a desired exercise, including for example by routing resistance band 114 around one or more of vertical members 104 and horizontal members 106. Shortening resistance band 114 may additionally increase the resistance experienced in a particular resistance band 114. Different resistance bands 114 may have different weight ratings, including for example between 10 pounds force and 100 pounds force when deflected an average distance. Additionally, adding bands would add the force associated with the bands, such as using one 20 pound band and one 50 pound band would provide 70 pounds force of resistance.

Exercise engagement portion 101 may include one or more brace 108. Brace 108 may extend from vertical member 104 to base portion 102. Brace 108 may extend from vertical member 104 to base portion 102 on an angle, such that brace 108 is placed in tension or compression upon vertical member 104 experiencing a bending moment. Brace 108 may be removably connected to base portion 102 by one or more fastener 128. Brace 108 may be removably connected to vertical member 104 by one or more fastener 130. Each vertical member 104 may include a pair of braces oriented on opposite sides of each vertical member 104, wherein the braces extend at an angle from vertical member 104 to a cover 122.

Exercise engagement portion 101 may include one or more upper horizontal bar 110 extending between two or more vertical members 104. Horizontal bar 110 may be oriented at about the midpoint (in the vertical direction) of exercise engagement portion 101. Horizontal bar 110 may be oriented to permit a user to perform inclined pushups and/or standing pushups, depending upon the height of horizontal bar 110. Horizontal bar 110 may slide through vertical member holes 105. Horizontal bar 110 may have clips (e.g., hairpin clips) configured to engage horizontal bar 110 when mounted to exercise engagement portion 101 to prevent horizontal bar 110 from inadvertently disengaging from one or more vertical member 104.

Base portion 102 may include a ballast container 120 having a cover 122. Cover 122 may be selectively fixed to ballast container 120 via one or more fastener 124. Ballast container 120 may include one or more handle 126 to assist in transport and positioning of ballast container 120 and apparatus 100. Ballast container 120 may include casters 140 on a lower side, opposite vertical member 104 to assist in transport and positioning of ballast container 120 and apparatus 100. Casters 140 may be lockable to prevent movement of ballast container 120 when desired by a user (e.g., when exercising using apparatus 100).

Fasteners 124, 128, 130, and/or 132 may include wingnuts to permit a user to connect and appropriately tighten fasteners 124, 128, 130, and/or 132 without any tools other than a user's fingers and hands.

One or more vertical member 104 may extend orthogonally from cover 122.

Base portion 102 may include one or more lower horizontal bar 112 extending between two or more ballast containers 120. Horizontal bar 112 may extend through holes in the sides of ballast containers 120. Horizontal bar 112 may have clips (e.g., hairpin clips) configured to engage horizontal bar 112 when mounted to ballast containers 120 to prevent horizontal bar 112 from inadvertently disengaging from one or more ballast containers 120.

Horizontal bar 112 may be oriented near the bottom of apparatus 100. Horizontal bar 112 may be oriented to permit a user to perform inclined pushups. Horizontal bar 112 may be oriented to provide a user with stability during leg lifts, wherein a user lays in a supine position with the user's head nearer horizontal bar 112 than the user's feet, and the user grips horizontal bar 112 with the user's hands. Horizontal bar 112 may be oriented to provide a user with stability during sit-ups, wherein a user lays in a supine position with the user's feet nearer horizontal bar 112 than the user's head, and the user hooks the user's feet or toes under horizontal bar 112.

The interior of ballast container 120 is illustrated in FIGS. 1I-1L, as well as additional details of base portion 102.

Cover 122 may include a channel 142 extending through the height of cover 122. Channel 142 is sized and shaped to accept vertical member 104 therethrough. Additionally, channel 142 extends through at least a portion of a vertical member base 148 within ballast container 120. With cover 122 secured to ballast container 120, vertical member 104 may be inserted through cover 122 and into vertical member base 148 to secure the lower longitudinal end of vertical member 104 during use of apparatus 100.

Ballast container 120 includes ballast 144 to be oriented within a compartment 146. Ballast 144 may be any of a variety of objects of sufficient weight to provide stability to apparatus 100 during use. For example, ballast 144 may be dumbbells or similar weights, and may be removed from ballast container 120 and used as dumbbells or weights during other exercises. Where ballast 144 is in the form of dumbbells, a user may find it easier to carry ballast 144 when ballast 144 is separated from ballast container 120 when transporting apparatus 100. Alternatively, dumbbells of a specific weight are fairly uniform in size and shape, and easy to acquire at a destination where apparatus 100 is to be transported. Ballast 144 may be water, sand, or like objects capable of being poured into a shape.

As illustrated in FIG. 1L, ballast container 120 may include a lower horizontal bar hole 150 configured to receive and secure horizontal bar 112.

Ballast container 120 may be configured to contain hardware (e.g., bolts and nuts), resistance bands, clips, and the like when apparatus 100 is disassembled.

To assemble apparatus 100, empty ballast containers 120 may be placed in their approximate end position (e.g., with the appropriate spacing and orientation relative to one another) and casters 140 are locked, if present. Ballast 144 may be added to compartments 146, after which cover 122 may be placed upon and secured to ballast container 120. Vertical members 104 may be inserted into respective channels 142. Braces 108 may be placed into position and fixed to cover 122 via fasteners 128 and vertical members 104 via fasteners 130. Horizontal members 106 are arranged between vertical members 104, and fixed to vertical members via fasteners 132 (see FIGS. 1M and 1O). Upper horizontal bar 110 (see FIG. 1N) and lower horizontal bar 112 may be installed, if desired. Resistance band 114 may be attached to any of vertical member holes 105 and horizontal member holes 107 via clips 116.

As illustrated in FIGS. 1Q and 1R, a chair 152 may be used for exercising with apparatus 100. Chair 152 may be a stationary chair. Chair 152 may be used with apparatus 100 by individuals unable to stand while exercising. Chair 152 may include arms 153, upon which a user may rest the user's arms during exercise.

Figure 1S:
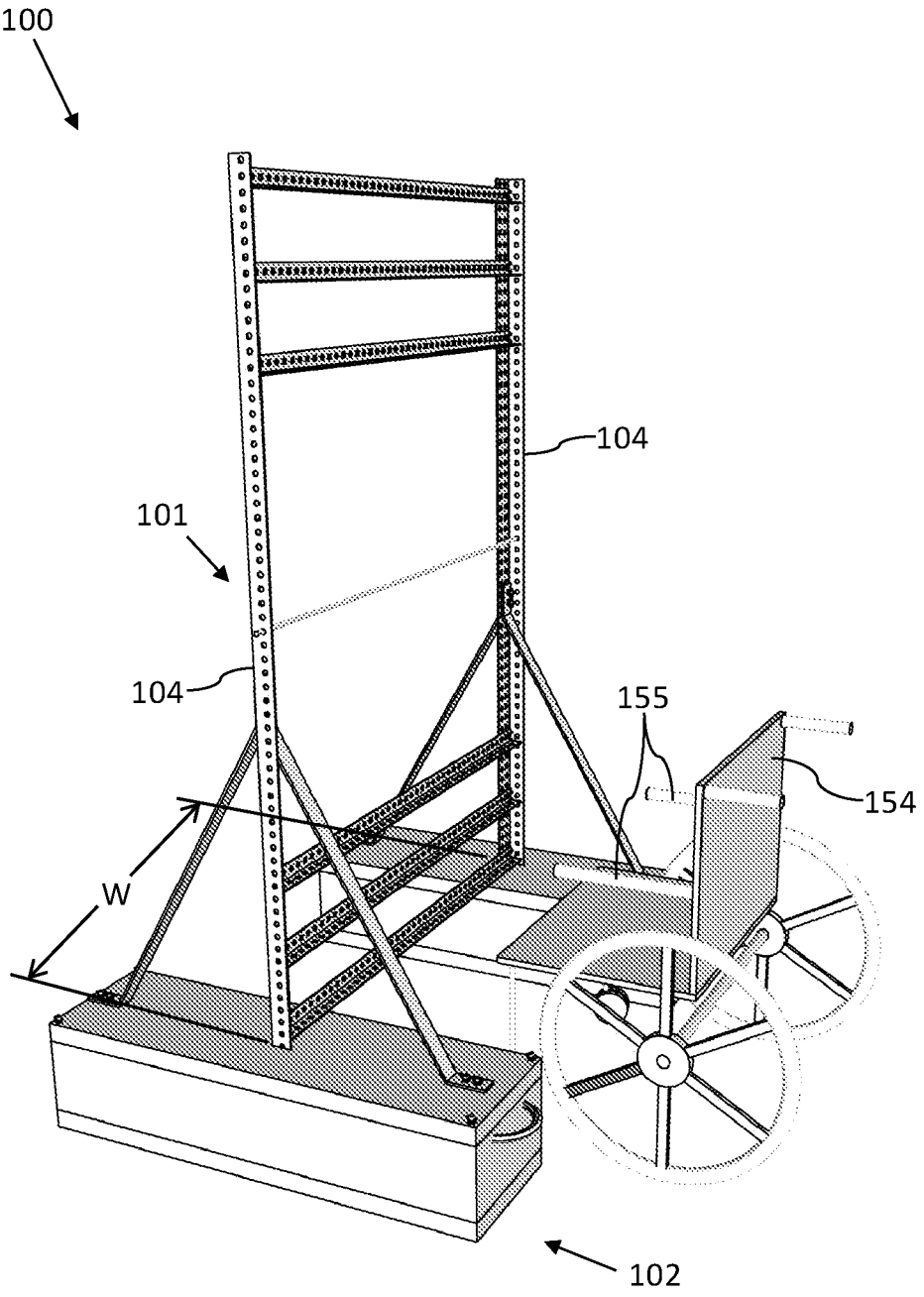
FIG. 1S illustrates a front perspective view of exercise apparatus 100 used with a wheelchair 154.
Figure 1T:
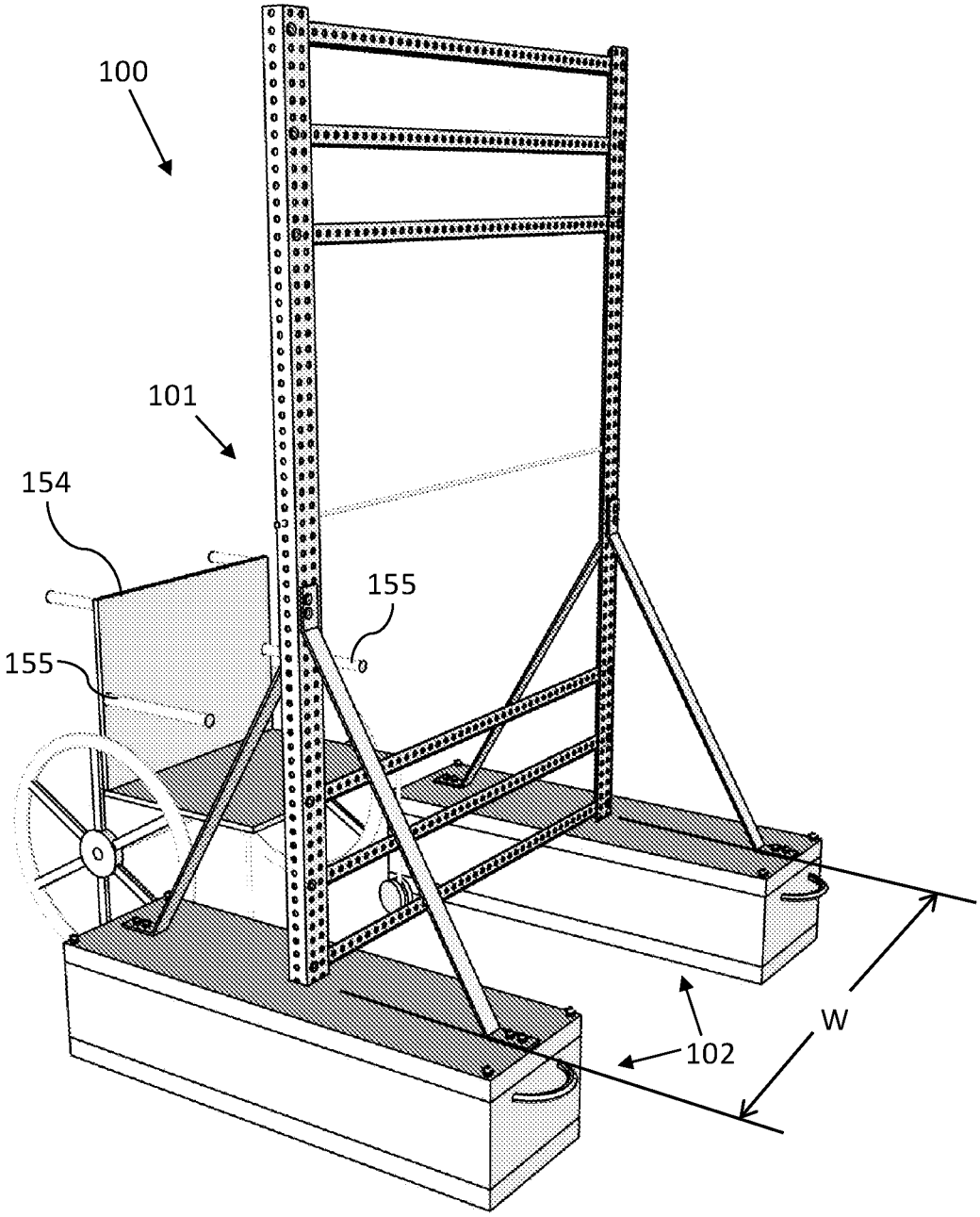
FIG. 1T illustrates a rear perspective view of exercise apparatus 100 used with wheelchair 154.

As illustrated in FIGS. 1S and 1T, a wheelchair 154 may be used for exercising with apparatus 100. Wheelchair 154 may be a mobile chair. Alternatively, wheelchair 154 may take the form of a mobility scooter. Wheelchair 154 may be used with apparatus 100 by individuals unable to stand while exercising. Wheelchair 154 may include arms 155, upon which a user may rest the user's arms during exercise.

As illustrated in FIGS. 1Q-1T, vertical members 104 may be separated by a width W. Width W may be any of a variety of widths wherein apparatus 100 is still usable. One may wish apparatus 100 to be narrower to take up less space. One may wish apparatus 100 to be wider to accommodate the use of a chair (e.g., chair 152), wheelchair (e.g., wheelchair 154), mobility scooter, stool, or the like. One may wish apparatus 100 to be narrower or wider to accommodate the size of the user. In one aspect, width W may be about 32.0 in. In another, width W may be about 40.0 in. Width W may be between 32.0 in. and 40.0 in.

Figure 2A:
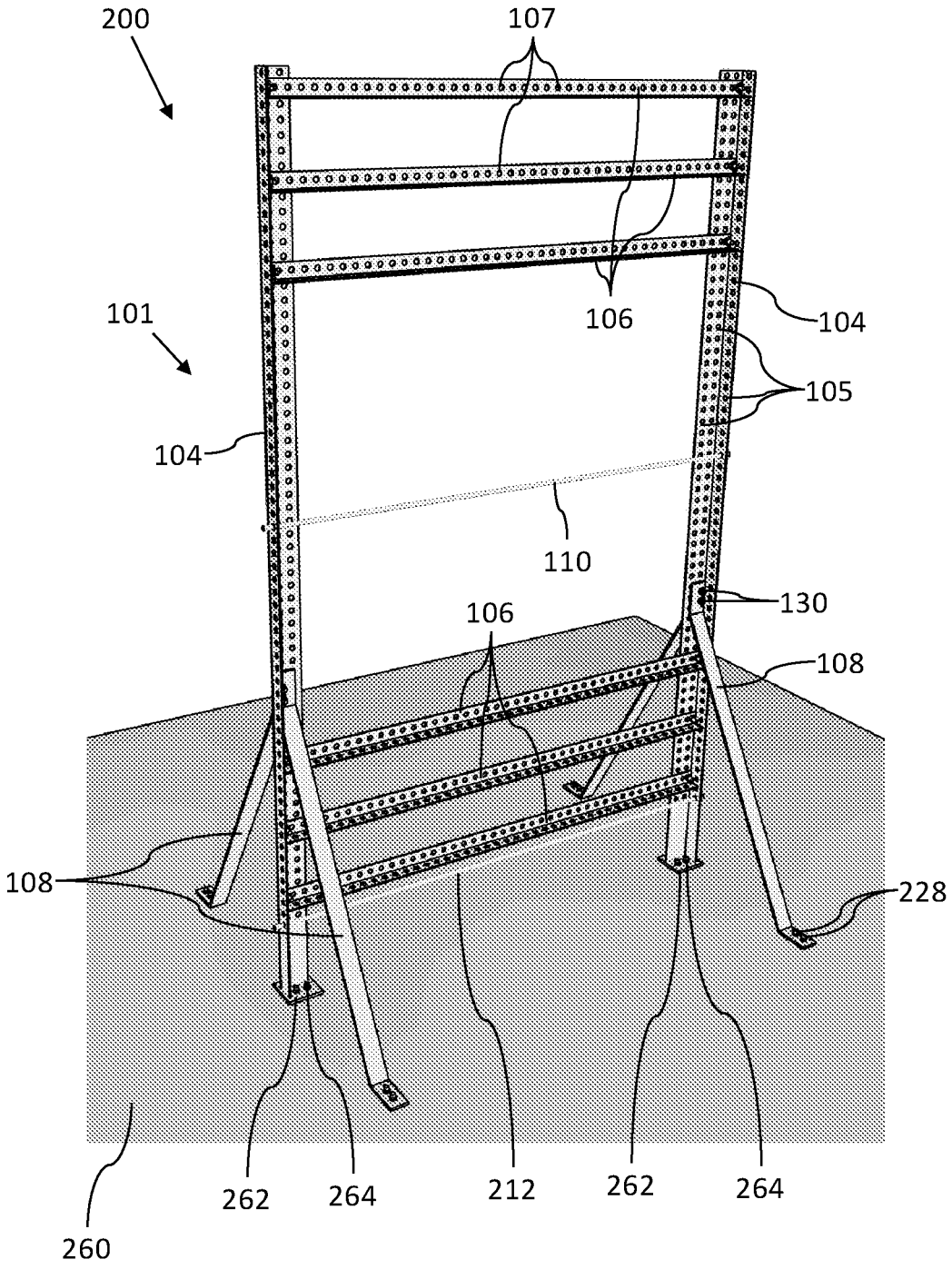
FIG. 2A illustrates a front perspective view of an exercise apparatus 200 fixed to a floor 260.
Figure 2B:
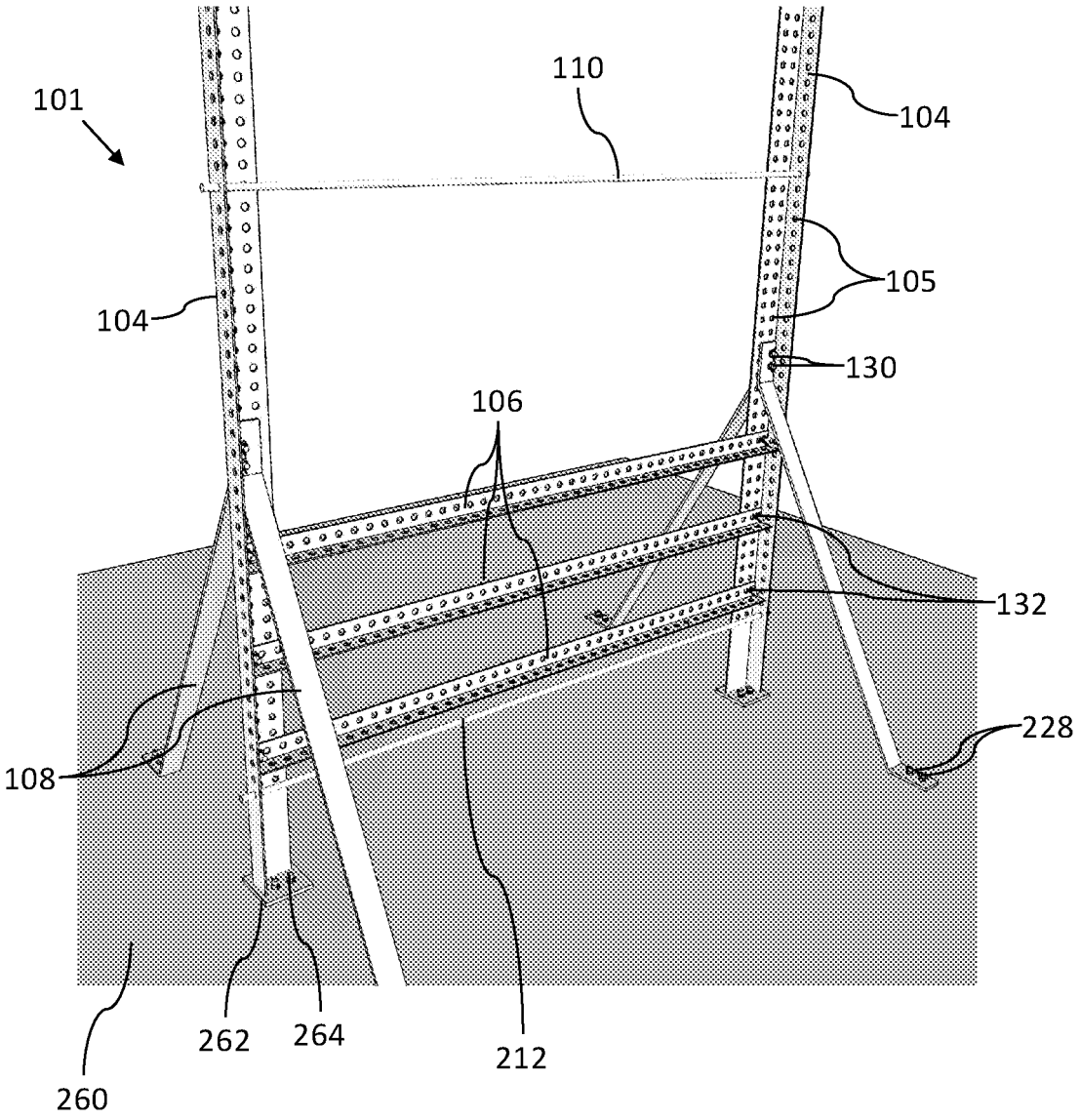
FIG. 2B illustrates a partial perspective view of exercise apparatus 200 fixed to floor 260.
Figure 2C:
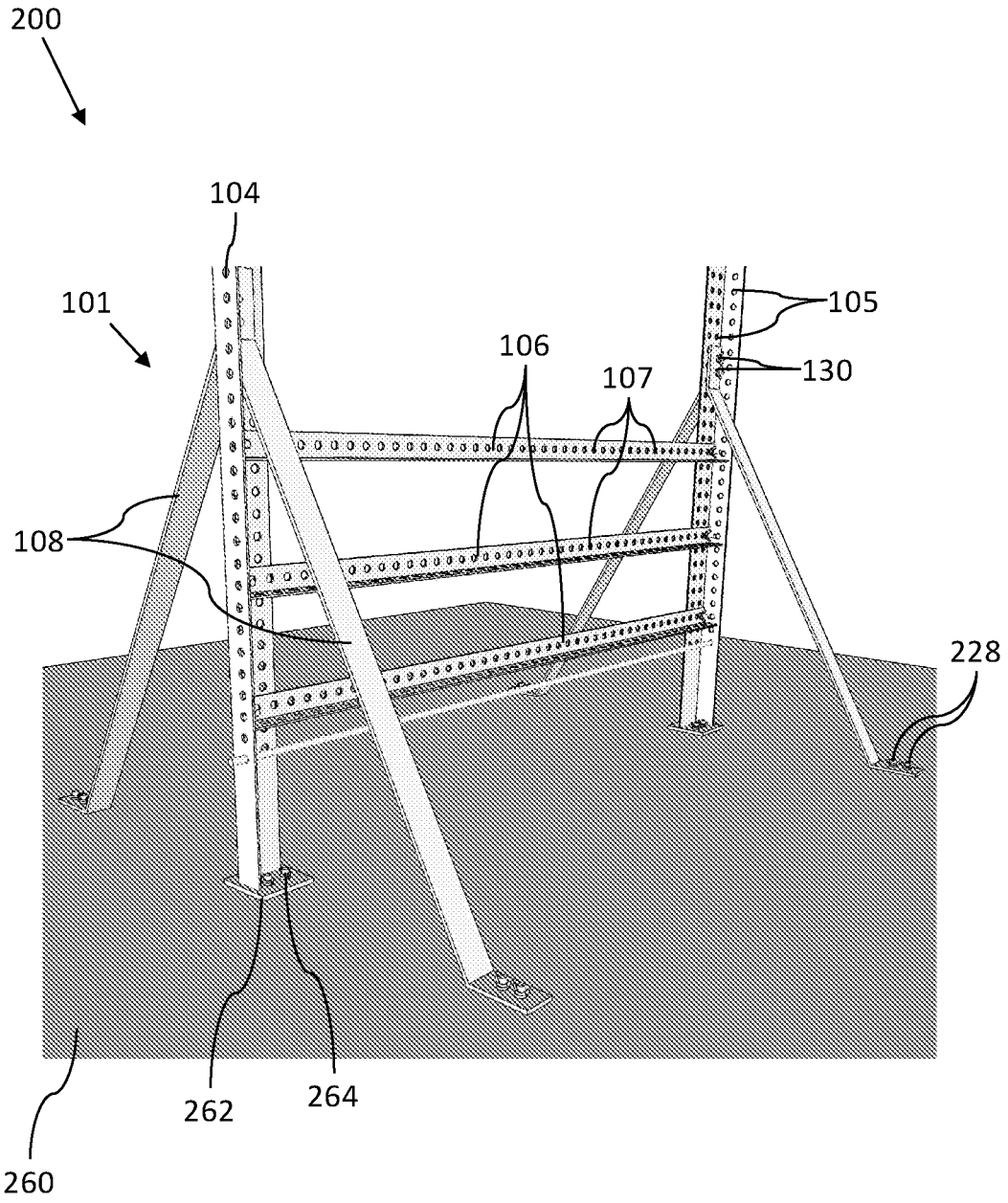
FIG. 2C illustrates a partial perspective view of exercise apparatus 200 fixed to floor 260.

FIGS. 2A-2C illustrate an exercise apparatus 200 fixed to a horizontal floor 260. Elements sharing the same reference numerals are the same as described above with respect to FIGS. 1A-1R, and thus are not again described below.

Apparatus 200 includes vertical member base pads 262 fixed to the lower longitudinal end of vertical members 104 (e.g., via welding). Base pads may be secured to floor 260 via fasteners 264.

Braces 108 may be secured directly to floor 260 via fasteners 228.

A lower horizontal bar 212 may be included extending between vertical members 104 in the same manner as upper horizontal bar 110. Lower horizontal bar 212 may be used in the same manner as lower horizontal bar 112 described above.

Otherwise, apparatus 200 may be used in the same manner as apparatus 100. Apparatus 200 may be stationary. Apparatus 200 may be permanently fixed to floor 260. Alternatively, apparatus 200 may be configured to be easily fixed to and removable from floor 260 via, for example, threaded male studs installed in floor 260.

Figure 3A:
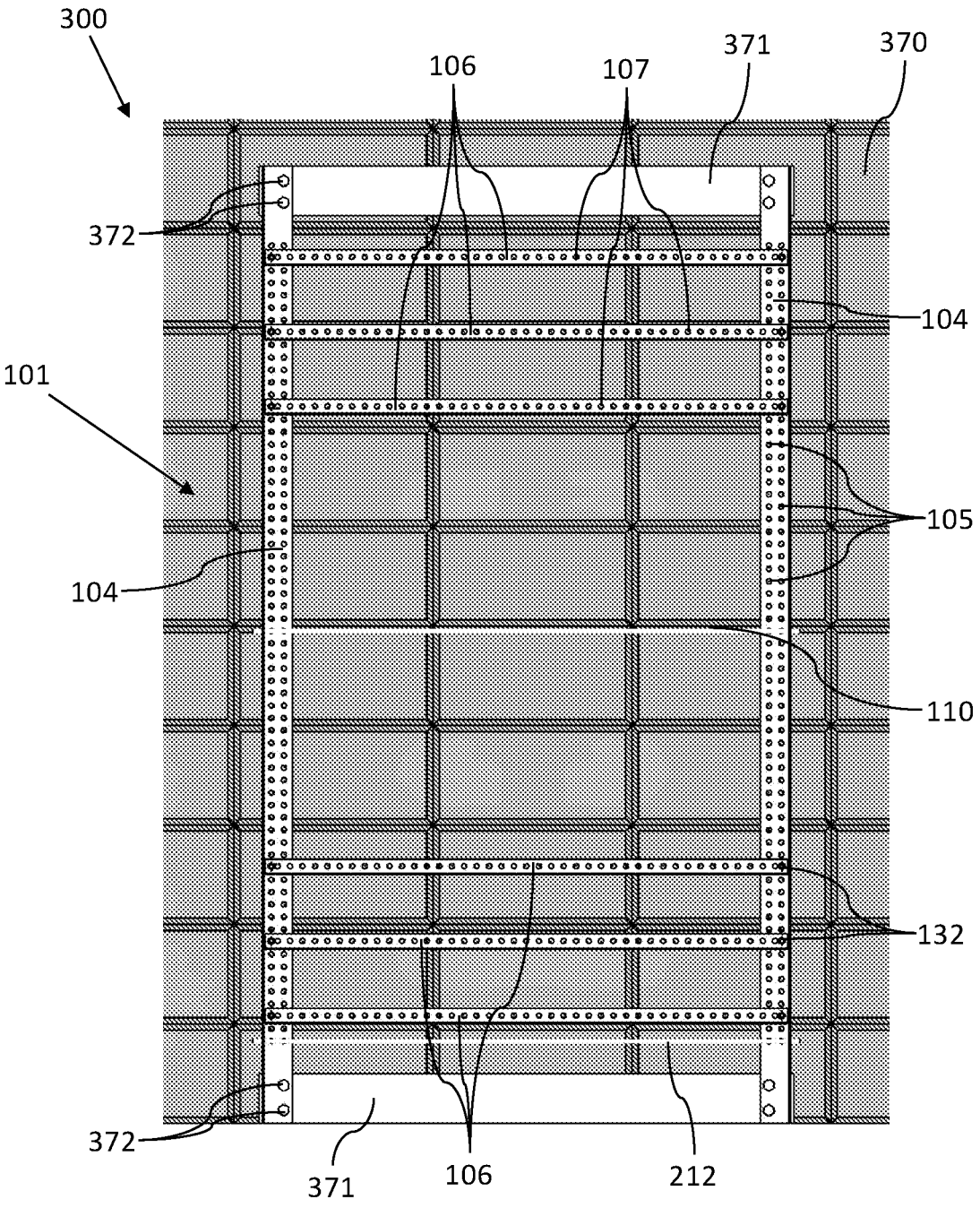
FIG. 3A illustrates a front elevation view of an exercise apparatus 300 fixed to a wall 370.
Figure 3B:
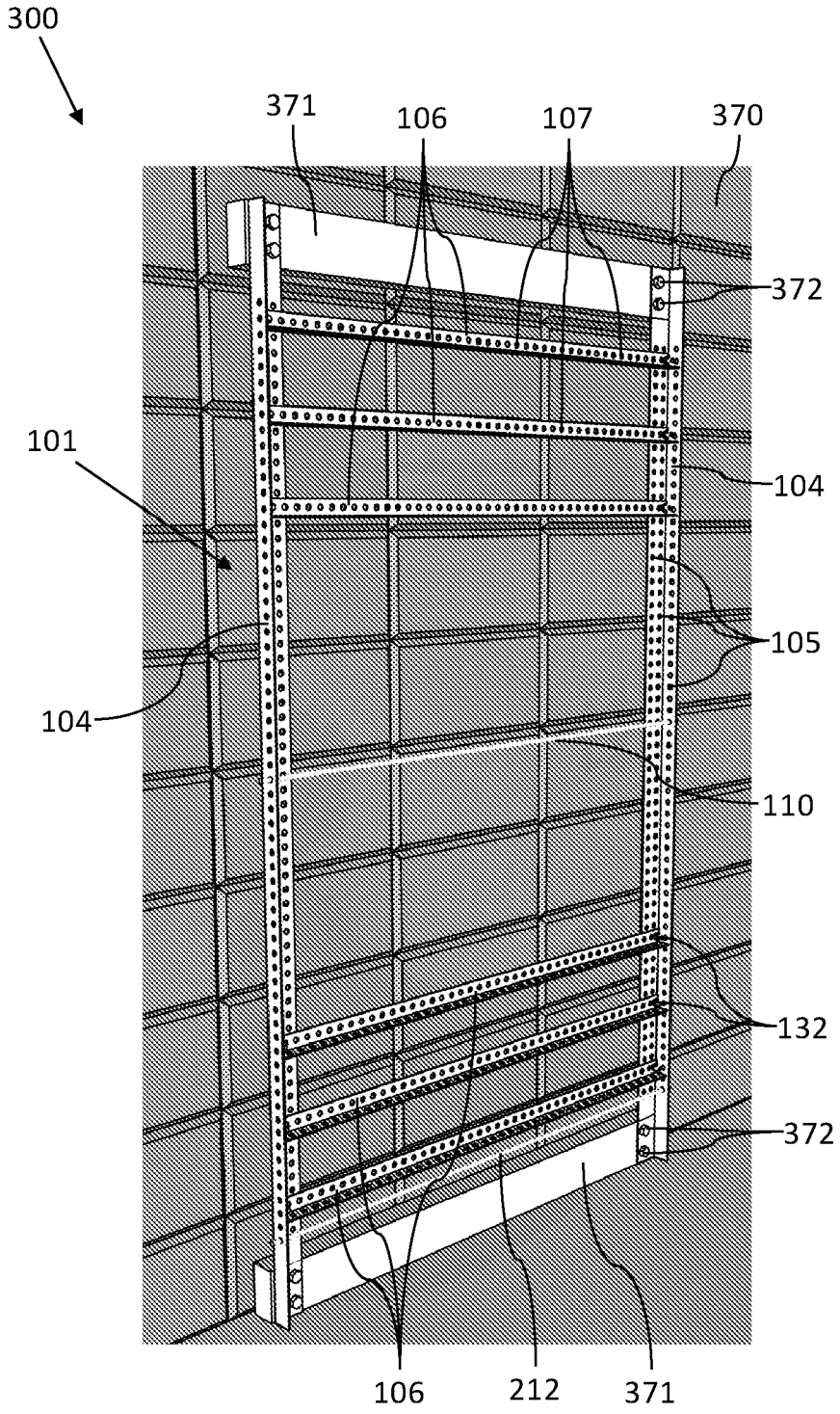
FIG. 3B illustrates a front perspective view of exercise apparatus 300 fixed to wall 370.
Figure 3C:
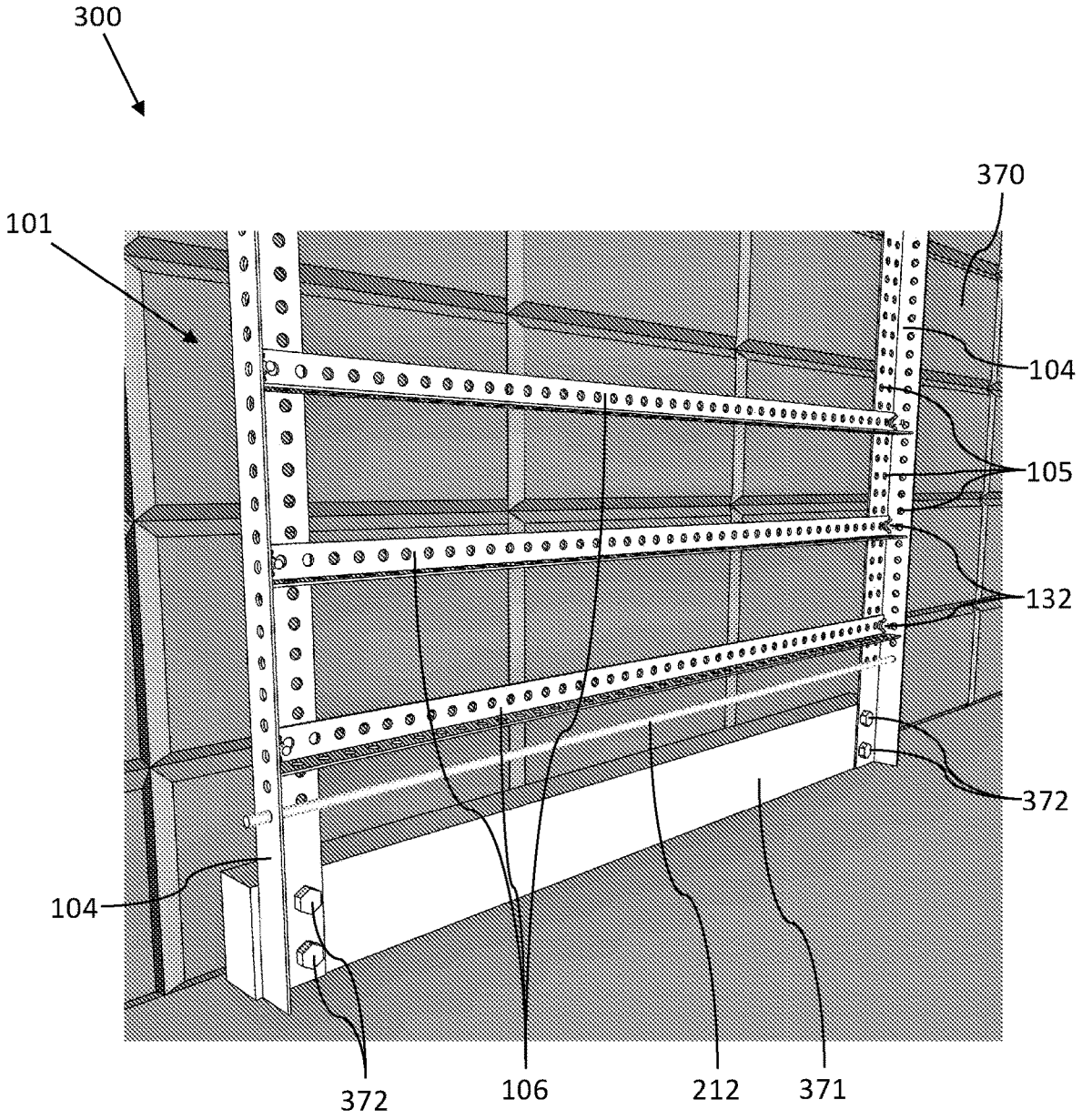
FIG. 3C illustrates a partial perspective view of exercise apparatus 300 fixed to wall 370.

FIGS. 3A-3C illustrate an exercise apparatus 300 fixed to a vertical wall 370. Elements sharing the same reference numerals are the same as described above with respect to FIGS. 1A-1R and FIGS. 2A-2C, and thus are not again described below.

Apparatus 300 includes spacers 371 and fasteners 372 mounting vertical members 104 to a vertical wall 370. Spacers 371 may be fixed to wall 370 initially, after which fasteners 372 are used to mount vertical members 104 to spacers 371. Alternatively, spacers 371 may be used as standoffs to space vertical members 104 from wall 370, with fasteners 372 extending both through vertical members 104 and spacers 371 into wall 370.

Spacers 371 may be about 2 in. thick, thus providing a spacing of about 2 in. between vertical members 104 and wall 370. Spacers 371 may have a length equal to or exceeding the width of apparatus 300. Spacers 371 may be formed from any of a variety of materials, including for example a wood, a polymer, a metal, a composite, or the like.

Otherwise, apparatus 200 may be used in the same manner as apparatuses 100 and 200. Apparatus 300 may be stationary. Apparatus 300 may be permanently fixed to wall 370. Alternatively, apparatus 300 may be configured to be easily fixed to and removable from wall 370 via, for example, threaded male studs installed in wall 370, or via fasteners configured to be removably engaged with spacers 371.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." To the extent that the term "substantially" is used in the specification or the claims, it is intended to take into consideration the degree of precision available or prudent in manufacturing. To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. As used in the specification and the claims, the singular forms "a,"

"an," and "the" include the plural. Finally, where the term "about" is used in conjunction with a number, it is intended to include ±10% of the number. In other words, "about 10" may mean from 9 to 11.

As stated above, while the present application has been illustrated by the description of alternative aspects thereof, and while the aspects have been described in considerable detail, it is not the intention of the applicants to restrict or in any way limit the scope of the appended claims to such detail. Additional advantages and modifications will readily appear to those skilled in the art, having the benefit of the present application. Therefore, the application, in its broader aspects, is not limited to the specific details, illustrative examples shown, or any apparatus referred to. Departures may be made from such details, examples, and apparatuses without departing from the spirit or scope of the general inventive concept.

What is claimed is:

1. An exercise apparatus, comprising:

an exercise engagement portion comprising two vertical members and two or more horizontal members extending between the two vertical members, wherein the two or more horizontal members include longitudinal ends and wherein the longitudinal ends are connected to the two vertical members, wherein the two or more horizontal members are coplanar with the two vertical members, wherein each of the two or more horizontal members are vertically spaced from one another, wherein the two or more horizontal members include a plurality of horizontal member holes, and wherein the two vertical members include a plurality of vertical member holes;

a base portion including: a first ballast container and a second ballast container, the first ballast container including a first vertical member base having a first channel and one or more compartment for containing a ballast, and the second ballast container including a second vertical member base having a second channel and one or more compartment for containing a ballast, wherein each of the first ballast container and the second ballast container are oriented parallel to one another; and wherein a first of the two vertical members extends into the first channel of the first vertical member base and a second of the two vertical members extends into the second channel of the second vertical member base, such that each vertical member base maintains the respective vertical member in a vertical position.

2. The exercise apparatus of claim 1, further comprising a resistance band having terminal ends with clips connected to the terminal ends, wherein the clips are engaged with one or more of the plurality of horizontal member holes and the plurality of vertical members holes.

3. The exercise apparatus of claim 1, further comprising an upper horizontal bar extending between the two vertical members, wherein the upper horizontal bar is coplanar with the two vertical members.

4. The exercise apparatus of claim 1, further comprising a lower horizontal bar extending from a side of the first ballast container to a side of the second ballast container.

5. The exercise apparatus of claim 1, wherein each of the ballast containers includes a cover, and wherein the channel and the vertical member extends through a thickness of each cover.

6. The exercise apparatus of claim 1, wherein each of the ballast containers includes casters on a bottom side, and wherein the casters remain in direct contact with a horizontal floor during use of the exercise apparatus.

7. The exercise apparatus of claim 5, further comprising a pair of braces oriented on opposite sides of each of the two vertical members, wherein each of the braces extend at an angle from the vertical member to the cover.

8. The exercise apparatus of claim 1, wherein the ballast is one or more dumbbell.

9. The exercise apparatus of claim 1, wherein the two vertical members are separated by a width W, and wherein the width W is between 32.0 in. and 40.0 in.

* * * * *